United States Patent [19]

Johansson et al.

[11] Patent Number: 4,753,072

[45] Date of Patent: Jun. 28, 1988

[54] STIRLING ENGINE HEATING SYSTEM

[75] Inventors: Lennart N. Johansson; William H. Houtman, both of Ann Arbor, Mich.; Worth H. Percival, Asheville, N.C.

[73] Assignee: Stirling Power Systems Corporation, Ann Arbor, Mich.

[21] Appl. No.: 13,393

[22] Filed: Feb. 11, 1987

[51] Int. Cl.[4] ..... F02G 1/04

[52] U.S. Cl. ..... 60/517; 60/524; 122/366; 165/104.21; 165/163

[58] Field of Search ..... 60/517, 524; 122/366; 165/104.21, 163

[56] References Cited

U.S. PATENT DOCUMENTS

| | | | |
|---|---|---|---|
| 3,702,533 | 11/1972 | Dirne et al. | 60/524 |
| 3,817,322 | 6/1974 | Asselman et al. | 60/524 X |
| 3,950,947 | 4/1976 | Dirne et al. | 60/524 |
| 4,033,130 | 7/1977 | Hermans | 60/524 X |
| 4,052,854 | 10/1977 | duPré et al. | 60/524 |

*Primary Examiner*—Allen M. Ostrager
*Attorney, Agent, or Firm*—Rhodes and Boller

[57] ABSTRACT

A heating system for improving the efficiency of a hot gas engine comprises a "heat pipe" type evaporator and condenser configuration forming a closed system for a condensing medium, such as sodium. The sodium is heated in the evaporator and vaporized. It flows through a conduit to the condenser where it condenses onto tubes which carry the hot working as for the engine, thereby heating the working gas. The condensed liquid sodium flows back through the conduit into the evaporator where it is again vaporized. This is a continuous cycle whereby a thermal power flow from the evaporator to the condenser is continuously induced by the heating of the sodium in the evaporator. The condenser comprises an outer cylindrical walled tube surrounding tubes which carry the hot working gas. These latter tubes are S-shaped and arranged in a bundle. The evaporator comprises inner and outer shells cooperatively arranged to form an evaporating chamber space of upright annular cup-shape which contains a wicking material on the inner shell wall to enhance the spreading of the condensate for efficient evaporation. A further shell is nested within the inner shell to cooperatively define an annular cup-shape heating passage for heating the evaporating chamber space through the inner shell.

21 Claims, 3 Drawing Sheets

STIRLING ENGINE HEATING SYSTEM

BACKGROUND AND SUMMARY OF THE INVENTION

This invention relates generally to hot gas engines, and in particular to a novel heating system for supplying the heat energy input to a Stirling engine.

U.S. Pat. No. 4,055,952, Johansson et al, relates to a Heating Device For An External Combustion Engine. A working gas, such as helium, is pumped back and forth through a closed path between low temperature compression and high temperature expansion cylinders. This path includes a heater and a cooler where heat is introduced and rejected respectively, and the cooperative effect is the execution of a thermodynamic cycle resulting in the development of mechanical output power at a crankshaft connected to the pistons which operate within the cylinders.

The heater described in that patent comprises a number of arcuately shaped tubes through which the working gas is conducted and a directly adjacent combustion device for heating the tubes. A liquid or gaseous fuel is combusted in a combustion chamber of the combustion device, and the hot gaseous products of combustion are caused to flow over the outside of the arcuately shaped tubes thereby heating the working gas which flows through the tubes. The engine of the patent possesses a number of characteristics which advantageously distinguish it from other power plants. They include multi-fuel use, relatively lower vibration and noise, and relatively smoother operation, among others.

The efficiency of the engine is related to the temperature of the working gas, the higher the temperature, the greater the efficiency. In a heater of the general type disclosed in the patent, the ability of materials to withstand elevated temperatures limits the temperature to which the working gas can be heated.

In actual construction, an engine like that shown in the patent comprises a brazed tube and fin assembly for maximizing the heat transfer surface area. Heat of the combustion gases is transferred through the fins to the tubes to heat the working gas. As in any heating device, the life of the heater is a function of the thermal stress to which the materials of its component parts are subjected. At higher. temperatures which are desirable for improving the engine efficiency, there are higher stresses and consequently a lower life expectancy. Accordingly, to avoid unacceptably low life expectancy, the heater is exposed to lower maximum temperatures, but this of course is at the expense of reduced engine efficiency. Maximum temperatures will occur at the fin tips, making the temperature tolerance of the fin material the limiting factor in improving the engine efficiency.

The present invention relates to a novel heating system for improving the efficiency of the engine while maintaining acceptable life expectancies for the heater. According to general principles of the invention, use of a condensing substance as the heat transfer fluid medium and the elimination of fins on the tubes can improve efficiency without compromising life expectancy as much as if temperature were raised in the prior heater designs shown in the patent and discussed above. With the present invention the outer surfaces of the tubes become the points of maximum temperature, rather than the fin tips, and the tube material therefore becomes the limiting factor in any trade-off between improved engine efficiency and acceptable heater life. Overall, a meaningful improvement is contemplated.

The invention still maintains one of the important advantages of this type of engine, namely the ability to be powered by different fuel sources. Other advantages inherent in the engine construction are also retained because the drive unit, namely the cylinders, block, and crankshaft, do not have to be modified. Of course the general principles of the invention are not limited to use in the specific engine configuration shown in the patent.

Briefly, the invention comprises what could be called a "heat pipe" type evaporator and condenser configuration forming a closed system for the condensing medium. Sodium is a suitable material for the medium. The sodium is heated in the evaporator and vaporized. It flows through a conduit to the condenser where it condenses onto the tubes which carry the hot working gas for the engine. The condensed liquid sodium flows back through the conduit into the evaporator where it is again vaporized. This is a continuous cycle whereby a thermal power flow from the evaporator to the condenser is continuously induced by the heating of the sodium in the evaporator.

Further aspects of the invention relate to the evaporator and the condenser details. The condenser comprises an outer cylindrical walled tube surrounding the tubes which carry the hot working gas. These latter tubes are arranged in a bundle, in which the individual tubes are parallel and of equal lengths, but spaced apart from each other within the bundle. Respective headers are at the respective ends of the bundle. The tubes have a lengthwise S-shape for thermal expansion and contraction, and the outer cylindrical walled tube contains an expansion joint for the same purpose.

The evaporator comprises inner and outer shells cooperatively arranged to form an evaporating chamber space of upright annular cup-shape. Returning condensate enters the evaporating chamber space at the chamber space's upper rim. It flows into an annular trough on the inner shell wall for annular distribution and subsequent overflowing of the trough to flow down the inner wall. A wicking material is applied to the wall to enhance the spreading of the condensate over the entirety of the wall for promoting efficient evaporation. A further shell is nested within the inner shell to cooperatively define an annular cup-shape heating passage for heating the inner shell, and conseqently heating the condensate, by heat flow through the inner shell wall. The heating passage is part of a combustion device which provides the heat; specifically, hot gaseous products of combustion flow through the annular cup-shape heating passage.

A single conduit communicates the evaporating chamber space with the condensing chamber space, and the condensate and the evaporate both flow through this conduit, but in opposite directions. Where the conduit enters the evaporator it is provided with one or more holes above the level of the returning condensate flow so that evaporate can pass from the evaporating chamber space into the conduit without blockage by the condensate.

The foregoing features, advantages, and benefits of the invention will be seen in the ensuing description and claims which should be considered in conjunction with the accompanying drawings. The drawings disclose a preferred embodiment of the invention according to the best mode contemplated at this time in carrying out the invention.

DESCRIPTION OF THE PREFERRED EMBODIMENT

Figure 1:
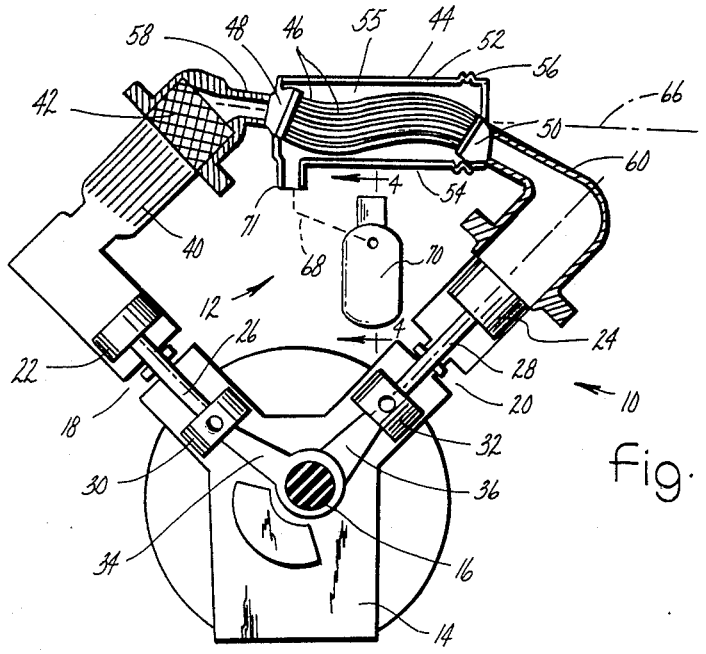
FIG. 1 is a semi-schematic transverse cross sectional view through a Stirling engine containing the improved heating system of the present invention.

FIG. 1 illustrates a hot gas engine 10 containing the heating system 12 of the present invention. Except for the new heating system 12, the illustrated engine 10 is like that illustrated in the Johansson et al U.S. Pat. No. 4,055,952. Hence, the engine 10 comprises a drive unit which has a casing or block 14 containing a crankshaft 16. The drive unit has what are referred to as a low temperature compression cylinder 18 and a relatively higher temperature expansion cylinder 20 arranged in a V configuration. In each cylinder there is a corresponding piston 22, 24 connecting via a corresponding piston rod 26, 28 to a corresponding cross head 30, 32, and in turn cranks 34, 36 which connect to crankshaft 16. The action of the two pistons 22, 24 in the respective cylinders is phased apart, 90° in the example of the patent.

A hot working gas, such as helium for example, is confined in a closed path between the head ends of the two cylinders 18 and 20. This closed path comprises in order from the head end of compression cylinder 18: a cooler 40, a regenerator 42, and a condenser 44, the latter being part of heating system 12.

In operation, heating system 12 provides external heat to the working gas as the working gas passes through condenser 44.

The working gas moves back and forth between the two cylinders as the pistons reciprocate within their respective cylinders. Compressed working gas is caused to flow through cooler 40 where heat is extracted from the working gas and rejected as waste heat. Regenerator 42 serves as a combination heat source and heat sink by alternately absorbing heat from the working gas when the gas is relatively hotter and returning heat to the working gas when the gas is relatively cooler. Condenser 44 is where external heat is added to the working gas.

The result is that during a cycle, the hot gas expands causing crankshaft 16 to be driven and thereby develop useful output power. The operating cycle is a continuous one with the overall operation such that condenser 44 is the heat source where external heat is added and cooler 40 the heat sink where waste heat is rejected, and the hot working gas executes a thermodynamic cycle in the closed path between and including the pistons and cylinders resulting in the development of useful mechanical power at crankshaft 16.

Figure 2:
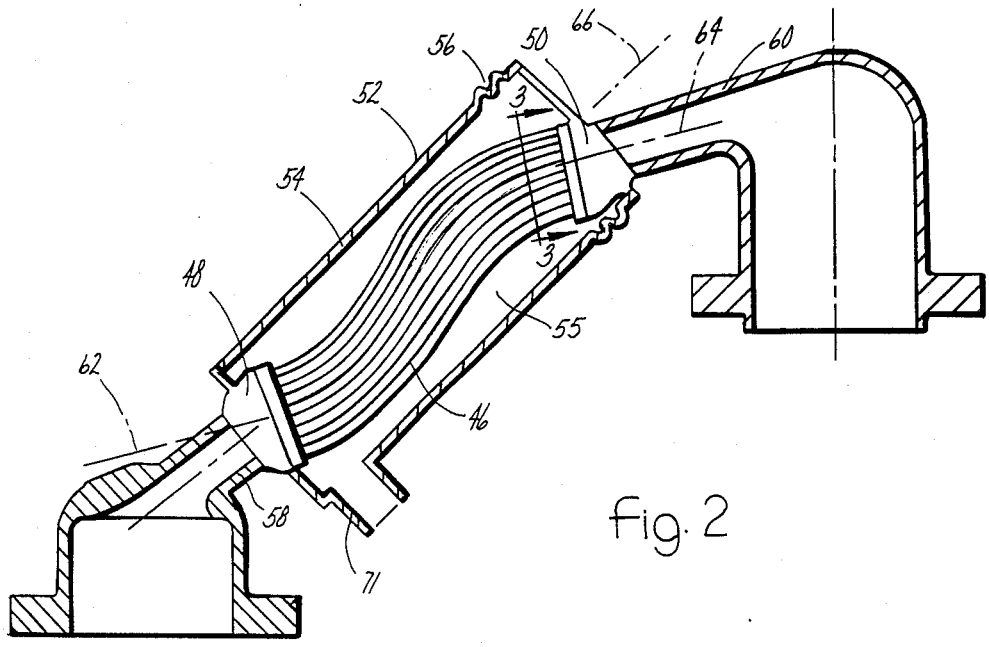
FIG. 2 is an enlarged fragmentary view of a portion of FIG. 1.
Figure 3:
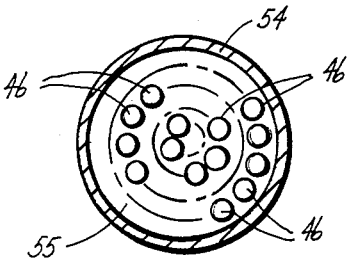
FIG. 3 is an enlarged transverse cross sectional view taken in the direction of arrows 3—3 in FIG. 2.

Details of condenser 44 are seen in FIGS. 1–3. A number of substantially identical individual tubes 46 are arranged as a bundle between a header 48 at one end of the bundle and a second header 50 at the opposite end of the bundle. The particular number of tubes used will be a function of various design considerations; but it is contemplated that thirty to forty tubes will be in a representative bundle. The individual tubes 46 are preferably of circular cylindrical transverse cross section formed into individual S-shapes between the two headers 48 and 50. The tubes are therefore essentially still parallel with one another although they are not straight. The purpose in making the tubes S-shaped is to allow for thermal expansion and contraction.

The condenser further comprises an enclosure 52 cooperatively arranged with respect to headers 48 and 50 to enclose the bundle of tubes 46. Enclosure 52 comprises a circular cylindrical wall 54 which extends lengthwise between the two headers 48 and 50. The ends of the condenser are shaped to provide for closure of the ends of cylindrical wall 54 with respect to both headers 48 and 50. Hence, the individual tubes 46 are enclosed within a condensing chamber space 55 formed by the cooperative effect of wall 54 and the closures at the ends around the two headers 48 and 50.

Although the wall 54 is shown to be straight, it does contain a corrugation 56 which forms an expansion joint to allow for the effects of thermal expansion and contraction.

One end of the bundle of tubes 46 fits with respect to header 48 in a sealed manner, and the opposite end of the bundle fits with respect to header 50 in a sealed manner. The headers form in effect manifold spaces to establish communication of the individual tubes to the respective flow paths 58 and 60 leading from the opposite ends of the condenser, to regenerator 42 in the case of header 48 and passage 58, and to expansion cylinder 20 in the case of header 50 and passage 60.

Each header 48 and 50 has its own axis 62, 64 respectively, and the ends of the tubes at each header are received in the header in parallel to the header's own axis. As such, with the illustrated S-shaped tube configuration, the axes of the two headers are not colinear with each other, nor are they colinear with what would be considered the main longitudinal axis 66 of wall 54.

As can be seen in FIG. 3, the individual tubes 46 of the bundle are spaced apart from each other and also from outer wall 54.

A communication path 68 extends between condenser 44 and an evaporator 70, these also being parts of heating system 12. The communication path is a tubular passage, one end of which communicates to the interior condensing chamber space 55 of condenser 44. This point of communication is identified by the reference numeral 71 and is illustrated as a generally radial entrance into wall 54 adjacent the end which contains header 48. As such, this point of communication is at a relatively low point of the condenser.

Figure 6:
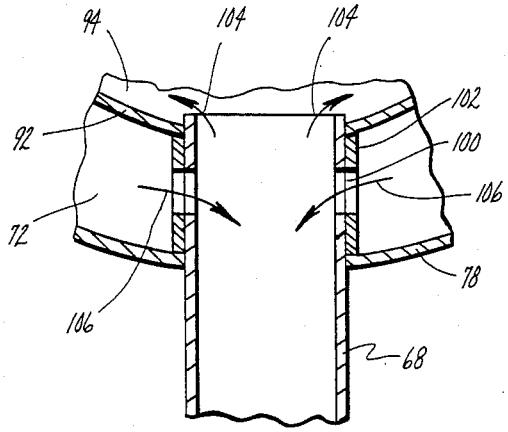
FIG. 6 is a generally horizontal cross sectional view taken in the direction of arrows 6—6 in FIG. 5.
Figure 5:
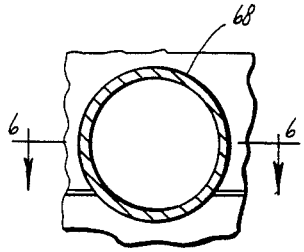
FIG. 5 is an enlarged transverse cross sectional view taken in the direction of arrows 5—5 in FIG. 4.
Figure 4:
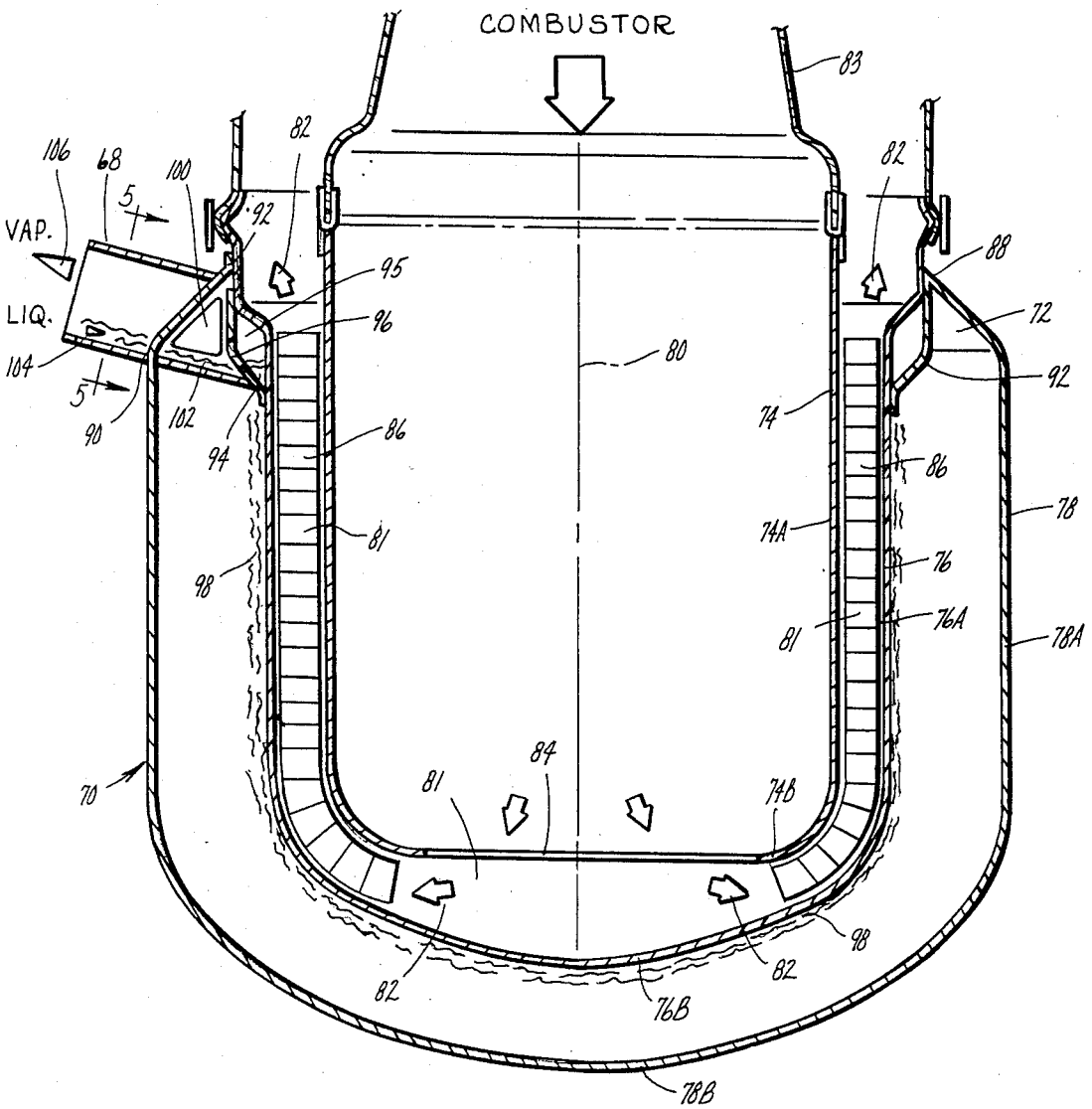
FIG. 4 is an enlarged vertical longitudinal sectional view taken in the direction of arrows 4—4 in FIG. 1.

The opposite end of the communication path 68 communicates to a relatively high point of an evaporating chamber space 72 of evaporator 70. Details are seen in FIGS. 4–6. The point of connection of conduit 68 to condenser 44 is at a higher elevation than its point of connection to evaporating chamber space 72.

Looking particularly at FIG. 4, evaporator 70 is seen to comprise three cup-shaped shells 74, 76, 78, respectively, which are organized and arranged in a generally nested manner with shell 74 nesting within shell 76 and the latter in turn nesting within shell 78. The axis of the evaporator is designated by the reference numeral 80, and it is disposed to be generally vertical.

Each shell 74, 76, 78 has a corresponding cylindrical sidewall 74A, 76A, 78A and a corresponding bottom end wall 74B, 76B, 78B. The two shells 74, 76 cooperatively define a flow passage 81. through which hot gaseous products of combustion flow in the manner depicted by the arrows 82 in FIG. 4. The source of these gases is a combustion device 83 which is cooperatively arranged with respect to shell 74. The combustion device 83 comprises a combustion zone in which a liquid or a gaseous fuel is combusted. The bottom end wall 74B of shell 74 comprises a hole 84 through which the combustion gases enter the annular space defined between the two shells 74, 76. As the hot combustion gases pass through hole 84, they flow outwardly and then upwardly along the wall of shell 76. FIG. 4 shows a finned matrix 86 between the two shells 74, 76. This component aids in the transfer of heat from the hot gas products of combustion to the wall of shell 76 by providing a larger surface area for heat transfer.

Shell 76 and shell 78 cooperatively define the evaporating chamber space 72, the two shells 76 and 78 being joined together in a sealed manner in a circular joint represented by the reference numeral 88. Hence, the evaporating chamber space has a general cup-shaped configuration.

The heating of shell 76, in the manner just described, is in turn effective to heat evaporating chamber space 72. The conduit 68 connects to the evaporator at the upper rim of the cup-shaped evaporating chamber space whereby evaporating chamber space 72, condensing chamber space 55, and communication conduit 68 form a completely closed volume.

A suitable thermal medium which possesses liquid and vapor phases at the temperatures of interest is contained within this closed volume. A suitable medium is sodium. Briefly, the sodium is evaporated in the evaporating chamber space by the heat input from the combustion device in the manner described above. The vapor flows through conduit 68 to condensing chamber space 55 where it passes across the individual tubes 46 of the bundle. The vapor condenses onto the tubes in the process of transferring heat energy to the engine hot working gas which is passing through the tubes 46. The liquid condensate in turn flows back through conduit 68 and returns to evaporator 70 where it is again vaporized. This is a continuous cycle in which the heating of the evaporator by the combustion device induces circulation of the medium in the manner just described.

Outermost shell 78 comprises a hole 90 through which an end of conduit 68 passes into evaporating chamber space 72. The conduit preferably enters chamber space 72 at a small inclined angle to the horizontal so that the returning condensate flows with the aid of gravity. The conduit axis is along a general radial to axis but at the inclined angle and the conduit extends to the wall of shell 76.

A ring 92 extends around shell 76 essentially at the level of conduit's 68 termination point within the evaporating chamber space and forms a shallow annular trough 94 at the bottom of the channel 95 cooperatively formed by the attachment of the ring to the wall. The returning condensate flows into the channel after exiting the conduit, the ring having a suitable entrance through which the condensate enters the channel. The channel and trough serve to convey the condensate around the top of chamber space 72 to enable substantially all of the hot shell wall 76 to be kept wet and thereby promote the efficient vaporization of the sodium as the cycle continues. This wetting is accomplished by providing a series of apertures 96 at intervals around ring 92 which are spaced above the lower margin of the ring which attaches to the inner shell wall in a sealed manner to form the bottom of the trough. As the level of sodium rises in the trough it will overflow the trough by passing through apertures 96. Consequently it spills down the shell wall.

As an aid to wetting the shell wall, a suitable wicking material 98 is adhered to the entire shell 76 below the level of ring 92. This wicking material forms a layer on the shell wall which is thick enough to catch and spread the liquid sodium. It is not thick enough however to obstruct the evaporating chamber space so that the remainder of that space remains free for the evaporate.

The evaporate passes upwardly through the chamber and enters conduit through one or more openings 100 into conduit 68 above the level of the returning condensate flow. These openings 100 are in the sidewall of the conduit above the level of the condensate, and it may be desirable to use a reinforcement, or gusset 102, in the joint between the conduit's end and the evaporator for strengthening purposes. The diameter of conduit 68 is sufficiently large for the fluid and vapor flows so that both are carried by the common conduit without one flow interfering with the other. FIGS. 5 and 6 show the returning condensate flow by the arrows 104 and the departing evaporate flow by the arrows 106.

With this new configuration for the heating system, a higher temperature can be imparted to the working gas resulting in improved engine efficiency without derogating the life expectancy of the component parts for a given temperature limit of the materials used in the component parts. While a preferred embodiment has been disclosed, it is to be appreciated that principles are applicable to other embodiments.

What is claimed is:

1. In a hot gas engine wherein a working gas flows back and forth in a closed path between a relatively cooler compression cylinder side of the engine and a relatively hotter expansion cylinder side of the engine and said path contains means including a heat source and a heat sink acting upon the gas in cooperation with the compression and expansion cylinders to cause the gas to execute a thermodynamic cycle wherein useful mechanical output power is developed by the engine, the improvement in said heat source which comprises a plurality of individual tubes each forming a portion of the closed path for the working gas, and said tubes are arranged side by side and spaced apart from each other, an enclosure surrounds said tubes so as to form a closed condensing chamber space through which said tubes pass, an evaporator comprises a closed evaporating chamber space, a communicating means communicates said evaporating chamber space to said condensing chamber space, a medium which has liquid and vapor phases is confined within said closed chamber spaces and said communicating means, said evaporator comprises heating means for heating the evaporating chamber space to vaporize said medium, and said closed chamber spaces and said communicating means are organized and arranged such that heating of the medium by the evaporator induces flow back and forth between said evaporating chamber space and said condensing chamber space such that the medium is vaporized in said evaporating chamber space, passes through said communicating means and into said condensing chamber space, passes over said tubes, condensing in the process as heat is transferred from the medium to the working gas flowing through the tubes, and the condensed medium flows as liquid from said condensing chamber space back through said communicating means to said evaporating chamber space where it is again vaporized, said tubes are curved S-shapes of substantially equal lengths, and spaced apart generally parallel with each other, one common header is provided for one end of the tubes and another common header is provided for the other end of the tubes, each header has its own axis, the tube ends at each header are received in parallel to the corresponding header's axis, and the axes of the two headers are non-colinear, the curved S-shapes of the tubes between said headers allowing for thermal expansion and contraction along the length of said tubes, and said enclosure comprising a generally cylindrical wall surrounding said tubes and means closing the ends of said cylindrical wall to said headers, and said enclosure comprising means to allow the thermal expansion and contraction.

2. The improvement set forth in claim 1 in which said enclosure cylindrical wall comprises a joint to allow for thermal expansion and contraction in the axial direction.

3. The improvement set forth in claim 2 in which said enclosure cylindrical wall is circular in shape and contains a corrugation forming said joint.

4. The improvement set forth in claim 3 in which said communicating means comprises a tubular conduit which connects to said condensing chamber space at a low point of said enclosure and to said evaporator at a high point of said evaporating chamber space, and said low point of said enclosure is disposed at a vertical elevation above that of said high point of said evaporating chamber space.

5. The improvement set forth in claim 4 in which said evaporator comprises inner and outer walls forming said evaporating chamber space as an annular cup-shape, and said high point of said evaporating chamber space is at the rim of said annular cup-shape.

6. The improvement set forth in claim 5 in which said heating means for the evaporating chamber space comprises means for applying heat to said inner wall on the surface thereof which is exerior to said evaporating chamber space, and including wicking material disposed on said inner wall within the evaporating chamber space for aiding in the distribution of liquid medium over said inner wall, said communicating means being disposed to cause liquid medium returning to the evaporating chamber space to be directed onto said inner wall.

7. The improvement set forth in claim 1 in which said evaporator comprises inner and outer walls forming said evaporating chamber space as an annular upright cup-shape, and said communicating means comprises a tubular conduit which connects to said evaporating chamber space at the rim of said annular upright cup-shape.

8. The improvement set forth in claim 7 in which said heating means for the evaporating chamber space comprises means for applying heat to one of said walls on a surface thereof which is exterior to said evaporating chamber space, and said tubular conduit being disposed to cause liquid medium returning to the evaporating chamber space to be directed onto said one wall.

9. The improvement set forth in claim 1 in which said communicating means comprises a single conduit which simultaneously conveys said medium in both liquid and vapor phases.

10. In a hot gas engine wherein a working gas flows back and forth in a closed path between a relatively cooler compression cylinder side of the engine and a relatively hotter expansion cylinder side of the engine and said path contains means including a heat source and a heat sink acting upon the gas in cooperation with the compression and expansion cylinders to cause the gas to execute a thermodynamic cycle wherein useful mechanical output power is developed by the engine, the improvement in said heat source which comprises a plurality of individual tubes each forming a portion of the closed path for the working gas, and said tubes are arranged side by side and spaced apart from each other, an enclosure surrounds said tubes so as to form a closed condensing chamber space through which said tubes pass, an evaporator comprises a closed evaporating chamber space, a communicating means communicates said evaporating chamber space to said condensing chamber space, a medium which has liquid and vapor phases is confined within said closed chamber spaces and said communicating means, said evaporator comprises heating means for heating the evaporating chamber space to vaporize said medium, and said closed chamber spaces and said communicating means are organized and arranged such that heating of the medium by the evaporator induces flow back and forth between said evaporating chamber space and said condensing chamber space such that the medium is vaporized in said evaporating chamber space, passes through said communicating means and into said condensing chamber space, passes over said tubes, condensing in the process as heat is transferred from the medium to the working gas flowing through the tubes, and the condensed medium flows as liquid from said condensing chamber space back through said communicating means to said evaporating chamber space where it is again vaporized, said tubes are arranged parallel with each orther and are of substantially equal lengths, one common header is provided for one end of the tubes and another common header is provided for the other end of the tubes, said tubes have a curved shape between said common headers to allow for thermal expansion and contraction, said enclosure forming said condensing chamber space comprises a joint to allow for thermal expansion and contraction in the axial direction, said enclosure forming said condensing chamber space comprises a cylindrical wall extending lengthwise of said tubes and means closing the ends of said cylindrical wall to said headers, each of said tubes has a curved S-shape, each header has its own axis, the tube ends at each header are received in parallel to the corresponding header's axis, and the axes of the two headers are non-colinear, said communicating means comprises a tubular conduit which connects to said condensing chamber space at a low point of said enclosure and to said evaporator at a high point of said evaporating chamber space, and said low point of said enclosure is disposed at a vertical elevation above that of said high point of said evaporating chamber space, said evaporator comprises inner and outer walls forming said evaporating chamber space as an annular cup-shape, and said high point of said evaporating chamber space is at the rim of said annular cup-shape, said heating means for the evaporating chamber space comprises means for applying heat to said inner wall on the surface thereof which is exerior to said evaporating chamber space, and including wicking material disposed on said inner wall within the evaporating chamber space for aiding in the distribution of liquid medium over said inner wall, said communicating means being disposed to cause liquid medium returning to the evaporating chamber space to be directed onto said inner wall, including a shallow trough extending around said inner wall disposed to receive liquid medium returning to said evaporating chamber space and distribute the medium by conveying same annularly around said inner wall and allowing the medium to overflow the trough and flow down said inner wall and wet said wicking material.

11. In a hot gas engine wherein a working gas flows back and forth in a closed path between a relatively cooler compression cylinder side of the engine and a relatively hotter expansion cylinder side of the engine and said path contains means including a heat source and a heat sink acting upon the gas in cooperation with the compression and expansion cylinders to cause the gas to execute a thermodynamic cycle wherein useful mechanical output power is developed by the engine, the improvement in said heat source which comprises a plurality of individual tubes each forming a portion of the closed path for the working gas, and said tubes are arranged side by side and spaced apart from each other, an enclosure surrounds said tubes so as to form a closed condensing chamber space through which said tubes pass, an evaporator comprises a closed evaporating chamber space, a communicating means communicates said evaporating chamber sapce to said condensing chamber space, a medium which has liquid and vapor phases is confined within said closed chamber spaces and said communicating means, said evaporator comprises heating means for heating the evaporating chamber space to vaporize said medium, and said closed chamber space and said communicating means are organized and arranged such that heating of the medium by the evaporator induces flow back and forth between said evaporating chamber space and said condensing chamber space such that the medium is vaporized in said evaporating chamber space, passes through said communicating means and into said condensing chamber space, passes over said tubes, condensing in the process as heat is transferred from the medium to the working gas flowing through the tubes, and the condensed medium flows as liquid from said condensing chamber space back through said communicating means to said evaporating chamber space where it is again vaporized, said evaporator comprises inner and outer walls forming said evaporating chamber space as an annular upright cup-shape, and said communicating means comprises a tubular conduit which connects to said evaporating chamber space at the rim of said annular upright cup-shape, said heating means for the evaporating chamber space comprises means for applying heat to one of said walls on a surface thereof which is exterior to said evaporating chamber space, and said tubular conduit being disposed to cause liquid medium returning to the evaporating chamber space to be directed onto said one wall, including wicking material disposed on said one wall within the evaporating chamber space for aiding in the distribution of liquid medium over said one wall and a shallow trough extending around said one wall disposed to receive liquid medium returning to said evaporating chamber space from said tubular conduit and distribute the medium by conveying same around said one wall and allowing the medium to overflow the trough and flow down said one wall and wet said wicking material.

12. The improvement set forth in claim 11 in which said tubular conduit includes means communicating with the free space bounding said wicking material within said evaporating chamber space to provide for conveyance of vaporized medium from said free space to the interior of said tubular conduit for conveyance via said communicating means to said condensing chamber space.

13. The improvement set forth in claim 12 in which said one wall is said inner wall.

14. In a hot gas engine wherein a working gas flows back and forth in a closed path between a relatively cooler compression cylinder side of the engine and a relatively hotter expansion cylinder side of the engine and said path contains means including a heat source and a heat sink acting upon the gas in cooperation with the compression and expansion cylinders to cause the gas to execute a thermodynamic cycle wherein useful mechanical output power is developed by the engine, the improvement in said heat source which comprises a plurality of individual tubes each forming a portion of the closed path for the working gas, and said tubes are arranged sde by side and spaced apart from each other, an enclosure surrounds said tubes so as to form a closed condensing chamber space through which said tubes pass, an evaporator comprises a closed evaporating chamber space, a communicating means communicates said evaporating chamber space to said condensing chamber space, a medium which has liquid and vapor phases is confined within said closed chamber spaces and said communicating means, said evaporator comprises heating means for heating the evaporating chamber space to vaporize said medium, and said closed chamber spaces and said communicating means are organized and arranged such that heating of the medium by the evaporator induces flow back and forth between said evaporating chamber space and said condensing chamber space such that the medium is vaporized in said evaporating chamber space, passes through said communicating means and into said condensing chamber space, passes over said tubes, condensing in the process as heat is transferred from the medium to the working gas flowing through the tubes, and the condensed medium flows as liquid from said condensing chamber space back through said communicating means to said evaporating chamber space where it is again vaporized, said evaporator comprises inner and outer nested shells coopereatively forming said evaporating chamber space and said heating means comprises a further shell cooperatively nested with one of said inner and outer shells to form a fluid heating zone through which a heating fluid is conveyed to transfer heat through said one shell to evaporate said medium within said evaporating chamber space.

15. The improvement set forth in claim 14 in which said further shell is nested within said inner shell so that the fluid heating zone is formed by said further and inner shells.

16. The improvement set forth in claim 15 in which said inner shell comprises a generally cylindrical sidewall and an end wall closing one end of said sidewall, said further shell comprises a generally cylindrical sidewall nested within the generally cylindrical sidewall of said inner shell, said further shell comprising an end that confronts said end wall of said inner shell and contains aperture means for communicating a passage bounded by the sidewall of said further shell to the fluid heating zone formed by said further shell and said inner shell.

17. The improvement set forth in claim 16 including means for causing heating fluid to flow axially through the passage bounded by the sidewall of said further shell, to enter the fluid heating zone via said aperture means in said end of said further shell, and to flow through the fluid heating zone by passing radially through one portion of said zone between said end of said further shell and said end wall of said inner shell, and thence axially through another portion of said zone between said sidewalls of said further and inner shells.

18. The improvement set forth in claim 17 in which said heating means comprises a combustor for generating hot products of combustion to form the heating fluid.

19. In a hot gas engine wherein a working gas flows back and forth in a closed path between a relatively cooler compression cylinder side of the engine and a relatively hotter expansion cylinder side of the engine and said path contains means including a heat source and a heat sink acting upon the gas in cooperation with the compression and expansion cylinders to cause the gas to execute a therodynamic cycle wherein useful mechanical output power is developed by the engine, the improvement in said heat source which comprises a plurality of individual tubes each forming a portion of the closed path for the working gas, and an enclosure surrounds said tubes so as to form a closed condensing chamber space through which said tubes pass, an evaporator comprising a closed evaporating chamber space, a communicating means communicates said evaporating chamber space to said condensing chamber space, a medium which has liquid and vapor phases is confined within said closed chamber spaces and said communicating means, said evaporator comprises heating means for heating the evaporating chamber space to vaporize said medium, and said closed chamber spaceds and said communicating means are organized and arranged such that heating of the medium by the evaporator induces flow back and forth between said evaporating chamber space and said condensing chamber space such that the medium is vaporized in said evaporating chamber space, passes through said communicating means and into said condensing chamber space, passes over said tubes, condensing in the process as heat is transferred from the medium to the working gas flowing through the tubes, and the condensed medium flows as liquid from said condensing chamber space back through said communicating means to said evaporating chamber space where it is again vaporized, said evaporator comprises inner and outer walls forming said evaporating chamber space as an annular upright shape, and said communicting means comprises a tubular conduit which connects to said evaporating chamber space at the rim of said annular upright shape, said heating means for the evaporating chamber space comprises means for applying heat to one of said walls on a surface thereof which is exterior to said evaporating chamber space, and said tubular conduit being disposed to cause liquid medium returning to the evaporating chamber space to be directed onto said one wall, including a shallow trough extending around said one wall disposed to receive liquid medium returning to said evaporating chamber space from said tubular conduit and distribute the medium by conveying same around said one wall and allowing the medium to overflow the trough and flow down said one wall.

20. The improvement set forth in claim 19 in which wicking material is disposed on said one wall within the evaporating chamber space for aiding in the distribution of liquid medium over said one wall.

21. The improvement set forth in claim 19 in which said conduit includes aperture means in a sidewall portion thereof at a level above the returning flow of liquid medium so as to provide for entrance of vaporized medium from said evaporating chamber space into said conduit.

* * * * *

UNITED STATES PATENT AND TRADEMARK OFFICE

CERTIFICATE OF CORRECTION

PATENT NO. 4,753,072

DATED June 28, 1988

INVENTOR(S) : Lennart N. Johansson, William H. Houtman, and Worth H. Percival

It is certified that error appears in the above-identified patent and that said Letters Patent are hereby corrected as shown below:

At column 7, line 20, "the" should read --for--;

At column 8, line 67, "exerior" should read --exterior--;

At column 11, line 38, "spaceds" should read --spaces--.

Signed and Sealed this

First Day of November, 1988

*Attest:*

DONALD J. QUIGG

*Attesting Officer*

*Commissioner of Patents and Trademarks*